US008951146B2

(12) United States Patent
Margoles et al.

(10) Patent No.: US 8,951,146 B2
(45) Date of Patent: Feb. 10, 2015

(54) TOE-BIASED GOLF CLUB

(71) Applicant: Acushnet Company, Fairhaven, MA (US)

(72) Inventors: Ryan Margoles, Cardiff, CA (US); Gregory D. Johnson, Vista, CA (US); Noah de la Cruz, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 85 days.

(21) Appl. No.: 13/717,967

(22) Filed: Dec. 18, 2012

(65) Prior Publication Data

US 2014/0171219 A1 Jun. 19, 2014

(51) Int. Cl.
*A63B 53/04* (2006.01)

(52) U.S. Cl.
CPC ..... *A63B 53/0466* (2013.01); *A63B 53/04* (2013.01); *A63B 2209/00* (2013.01); *A63B 2053/0408* (2013.01)
USPC ..... 473/349

(58) Field of Classification Search
USPC ..... 473/349
See application file for complete search history.

(56) References Cited

U.S. PATENT DOCUMENTS

| | | | | |
|---|---|---|---|---|
| 1,536,616 | A * | 5/1925 | Manning | 473/331 |
| 4,413,825 | A * | 11/1983 | Sasse | 473/331 |
| 4,471,961 | A * | 9/1984 | Masghati et al. | 473/330 |
| 2003/0013543 | A1* | 1/2003 | Helmstetter et al. | 473/329 |
| 2008/0182681 | A1* | 7/2008 | Yokota | 473/350 |
| 2010/0120553 | A1* | 5/2010 | Beach et al. | 473/342 |
| 2012/0172146 | A1* | 7/2012 | Greaney et al. | 473/345 |

* cited by examiner

*Primary Examiner* — Michael Dennis
(74) *Attorney, Agent, or Firm* — Kevin N. McCoy

(57) ABSTRACT

A golf club head includes a striking face having an upper perimeter, a lower perimeter, a heel portion, a toe portion, and a posterior body portion comprising a crown portion and a sole portion. The crown is coupled to the upper perimeter of the striking face and the sole is coupled to the lower perimeter of the striking face. The golf club also includes a hosel for receiving a shaft. The heel is positioned below the hosel and the club head has a c.g. positioned towards the toe by a distance, Δz, from a vertical plane running perpendicularly through the crown, the sole, and the striking face.

15 Claims, 5 Drawing Sheets

TOE-BIASED GOLF CLUB

FIELD OF THE INVENTION

The present invention relates to an improved metalwood or driver golf club. More particularly, the present invention relates to a hollow golf club head with a non-central sweet spot, c.g., and bulge and roll to take advantage of the club head speed gradient across the club face.

BACKGROUND OF THE INVENTION

The various components of golf club design are generally well-known. These typically include a golf club head attached to a shaft and a grip. Depending on the type of club desired (i.e., an iron-, metalwood-, or driver-type club), specific subcomponents of the club head include face, heel, toe, sole, and, for a driver- or metalwood-type club, a crown, all of which can be tailored to directly impact the performance of the club. By varying the design specifications, therefore, manufacturers can tailor a golf club towards many specific performance characteristics.

Among the considerations in club head design are loft, lie, face angle, horizontal face bulge, vertical face roll, center of gravity ("c.g."), moment of inertia ("MOI"), and material selection. The interior design of the club head may include a hosel or shaft attachment means or adjustability, perimeter weights, and/or fillers. Because golf club heads have repeated impacts with golf balls, they must also be strong enough to retain structural integrity.

Players generally seek a metalwood and/or driver that delivers maximum distance and accuracy when the ball is struck on the "sweet spot." The sweet spot is the area of the club head that provides the maximum ball speed off the clubface while retaining the low golf ball spin required for maximum distance. Most current club heads are designed to have the sweet spot at the center (horizontally from face to toe, and vertically from sole to crown) of the face of the club. Additionally, the c.g. and bulge and roll are generally centrally positioned in line with the sweet spot.

One un-utilized anomaly of drivers and metalwoods, however, is that the sweet spot, while generally located in the center of the club face, is not located at the area of the club face that has the highest club head speed. Because the toe end of the club face is a greater distance from both the golfer (and, therefore, travels on a wider arc as the golf swings the club) and from the axis of the shaft (also traveling a wider arc as the club head rotates), it has a higher club head speed than the center of the club face, and an even greater difference in club head speed than the heel end of the club face. Even a small increase in club head speed is not unsubstantial when translated to yards of travel. A 1-mph increase in club head speed (at maximum COR) results in a 1.5-mph increase in ball speed. Given that for every mph increase in ball speed a gain of 2 yards in ball travel is noticed, this 1.5-mph increase results in 3 yards gained, without changing any other properties.

Because virtually all golf club manufacturers produce clubs with centrally-located sweet spots (and c.g.), the advantage of the higher club head speed near the toe of the club face has been ignored. There remains a need, therefore, for club head constructions that allow manufacturers to produce more forgiving drivers or metalwood clubs for mid-to-high handicap players while taking advantage of positioning the sweet spot and c.g. towards the toe of the club head which can lead to increased distance.

SUMMARY OF THE INVENTION

The present invention is generally directed to a golf club head, particularly a driver that includes a striking or hitting face having an upper perimeter, a lower perimeter, a heel, and a toe. The main body of the club head, a posterior body, is formed from a top crown and a bottom sole. The crown is coupled to the upper edge of the striking face and the sole portion is coupled to the lower edge of the striking face. The golf club also includes a hosel for receiving a shaft and grip. The hosel may be adjustable. The heel of the club is positioned below where the hosel enters the club head (and crown). The club head has a center of gravity (c.g.) internally positioned towards the toe portion of the striking face by a distance, $\Delta z$, from a vertical plane running perpendicularly through the crown, the sole, and the striking face.

In one embodiment, the club head c.g. is positioned at least 5 mm from the vertical plane, more preferably at least 10 mm from the vertical plane, and most preferably at least 15 mm from the vertical plane. The club head may additionally include a horizontal plane that is situated parallel to and positioned between the crown portion and the sole portion as to intersect the heel and the toe. In this embodiment, the c.g. is positioned at least 1 mm above the horizontal plane towards the crown portion (for a high c.g.) and in another embodiment, the c.g. is positioned at least 1 mm below the horizontal plane towards the sole portion (for a low c.g.).

The striking face is preferably not flat and is formed to include bulge and roll. The bulge preferably has a radius of curvature, more preferably at least 2 radii of curvature. At least 1 of the bulge radii of curvature is positioned the same distance from the vertical plane as the c.g. is from the vertical plane, but they may be offset if desired. The roll of the striking face is preferably positioned along the horizontal plane but may also be slightly above or below this plane, as desired.

In another embodiment, the crown portion is formed from two discrete materials, the second material being lighter in weight than the first to allow more weight to be distributed towards the toe of the club. The lighter material is preferably positioned closer to the heel than the toe and typically includes carbon fiber composites, aluminum, magnesium, thermoplastic, or thermoset polymers.

The present invention is also generally directed to a golf club head, such as a driver, that is formed from a striking face having an upper perimeter, a lower perimeter, a heel, and a toe. The driver has a posterior body formed from a crown and a sole. The crown is coupled to the upper perimeter of the striking face and the sole portion is coupled to the lower perimeter of the striking face. The sole portion has an area at least 20% less than the crown portion and is substantially smaller in size, again to allow movement of weight towards the front of the club towards the toe. The also includes a hosel for receiving a shaft and a grip. The heel portion located away from the hosel (not directly under it) and the club head has a c.g. located more towards the toe of the striking face by a distance, $\Delta z$, from a vertical plane running perpendicularly through the crown, the sole, and the striking face.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The golf club of the present invention can be any type of golf club, such a driver, a metalwood, a hybrid, an iron, a wedge, or a putter, but is preferably a club that is hollow in nature. Typical golf clubs that are hollow include, but are not limited to, drivers, metalwoods, and hybrid-type clubs. These clubs have club heads that generally constructed with combination of a sole, crown, hitting face, toe, and heel, which are connected to a shaft and grip to complete the club. The most preferred golf club is a driver, which has the largest internal volume and hitting face that allow the inventive club head to be realized in the largest number of possible embodiments.

Figure 1:
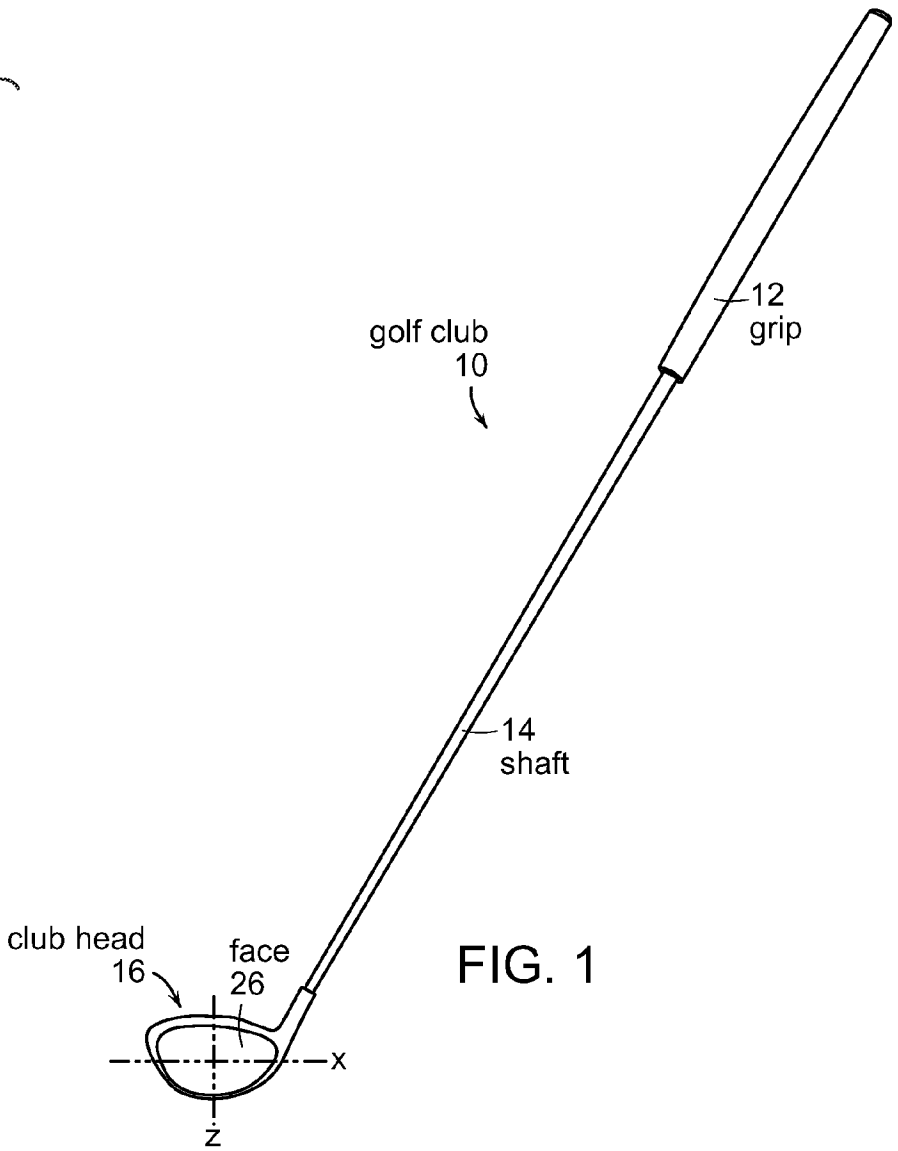
FIG. 1 is a perspective view of a golf club.
Figure 2:
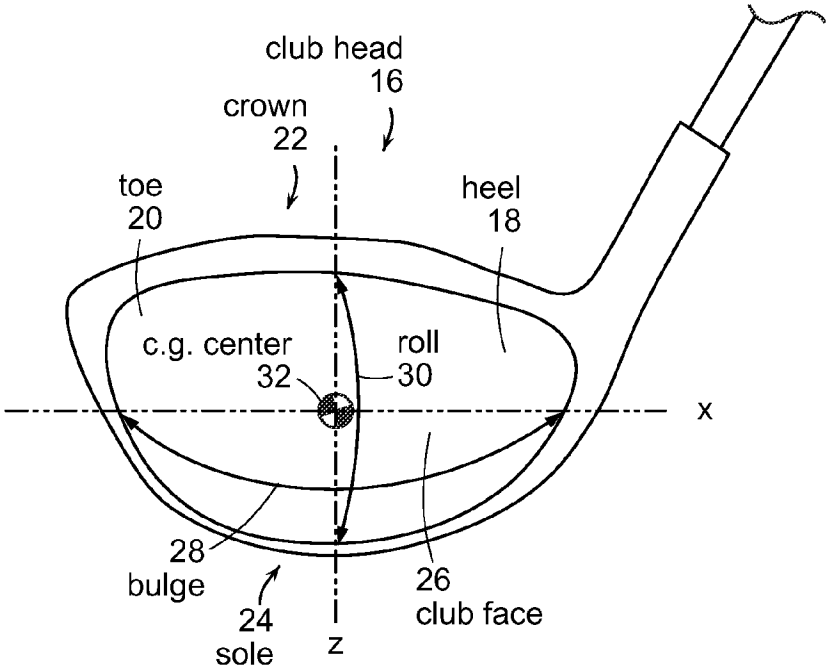
FIG. 2 is a close-up, face view of the head of the golf club.

FIGS. 1-2 show a driver-type golf club 10 comprising a grip 12, a shaft 14, and a club head 16. The club head 16 includes a heel 18, a toe 20, a crown 22, a sole 24, and a club face (also striking or hitting face) 26. The club head 16 has a curvature from the heel 18 to the toe 20 called the "bulge" 28, and a curvature from the crown 22 to the sole 24 called the "roll" 30. Club face 26 also has a center point 32 located at the geometric center of clubface 26.

The club face 26 can further be defined by an x-axis, x, that extends horizontally through (and co-linear with) the center of the club face 26 from the heel 18 to the toe 20; a z-axis, z, that extends vertically through (and co-linear with) the center of the club face 26 from the crown 22 to the sole 24; and a y-axis (not shown) that extends perpendicular into (axial to) the club face 26. The x-axis, y-axis, and z-axis are orthogonal to each another have an intersection point located at the center 32 of club face 26. A vertical plane (not shown) runs perpendicularly through the crown, the sole, and the striking face, and is co-planar with the z-axis and the y-axis.

The geometric center 32 of club face 26 is also typically the center of the "sweet spot" on the club face—it is preferred a golfer strike the golf ball in the vicinity of this location for best transfer of energy from the club head 16 to the ball. The center of gravity (c.g.) is also typically located some predetermined distance behind (away from) the geometric center 32 along the vertical plane defined above and can be above or below the y-axis. In an alternative embodiment, the c.g. is not located in the vertical plane and directly behind the geometric center 32.

Bulge 28 refers to the rounded properties of the club face 26 from the heel 18 to the toe 20. If a club face is rounded, then the angle that the golf ball leaves the club face relative to the intended target line will be increased for off-center shots. For example, if a golf ball is hit near the heel of the club face, then the ball will leave in an initial direction to the left of the target line but with sidespin. With an off-center heel shot, therefore, the ball can curve to the right so ideally the two effects will neutralize one another and produce a flight path that lands the ball close to the intended target line.

Roll 30 refers to the rounded properties of the club face 26 from the crown 22 to the sole 24. When the club face hits the ball, the ball acquires some degree of backspin. Typically this spin is greater for shots hit below the center line of the club face than for shots hit above the center line of the club face.

Sweet spot, although commonly used within the golf industry as a desirable indicator of golf club performance, is seldom defined in a way that is easily quantifiable. As used herein, the sweet spot is defined as the portion of club face 26 that is capable of achieving at least 98% of a maximum ballspeed that can result from an impact with a golf ball. Traditional drivers had sweet spots that are roughly circular in shape and small in size, covering an area of less than 35 $mm^2$, 30 $mm^2$, or even less than 27 $mm^2$. The sweet spot of the present invention may be circular in shape, but is preferably oval in shape and covers an area greater than about 45 $mm^2$, more preferably greater than about 46.5 $mm^2$, and most preferably greater than about 48.0 $mm^2$.

The novel club head of the present invention results from a non-conventional translating of the sweet spot, c.g., bulge, and roll, individually or in combination, toe-ward—that is, the sweet spot is not in the geometric center 32 of the club face—to take advantage of the clubhead speed gradient that exists during a golf swing and impact with a golf ball. Preferably, the vertical plane running perpendicularly through the crown, the sole, and the striking face, defined above as being co-planar with the y-axis and z-axis, is translated towards the toe of the clubhead and the c.g. is translated the same distance as the vertical plane.

Figure 3:
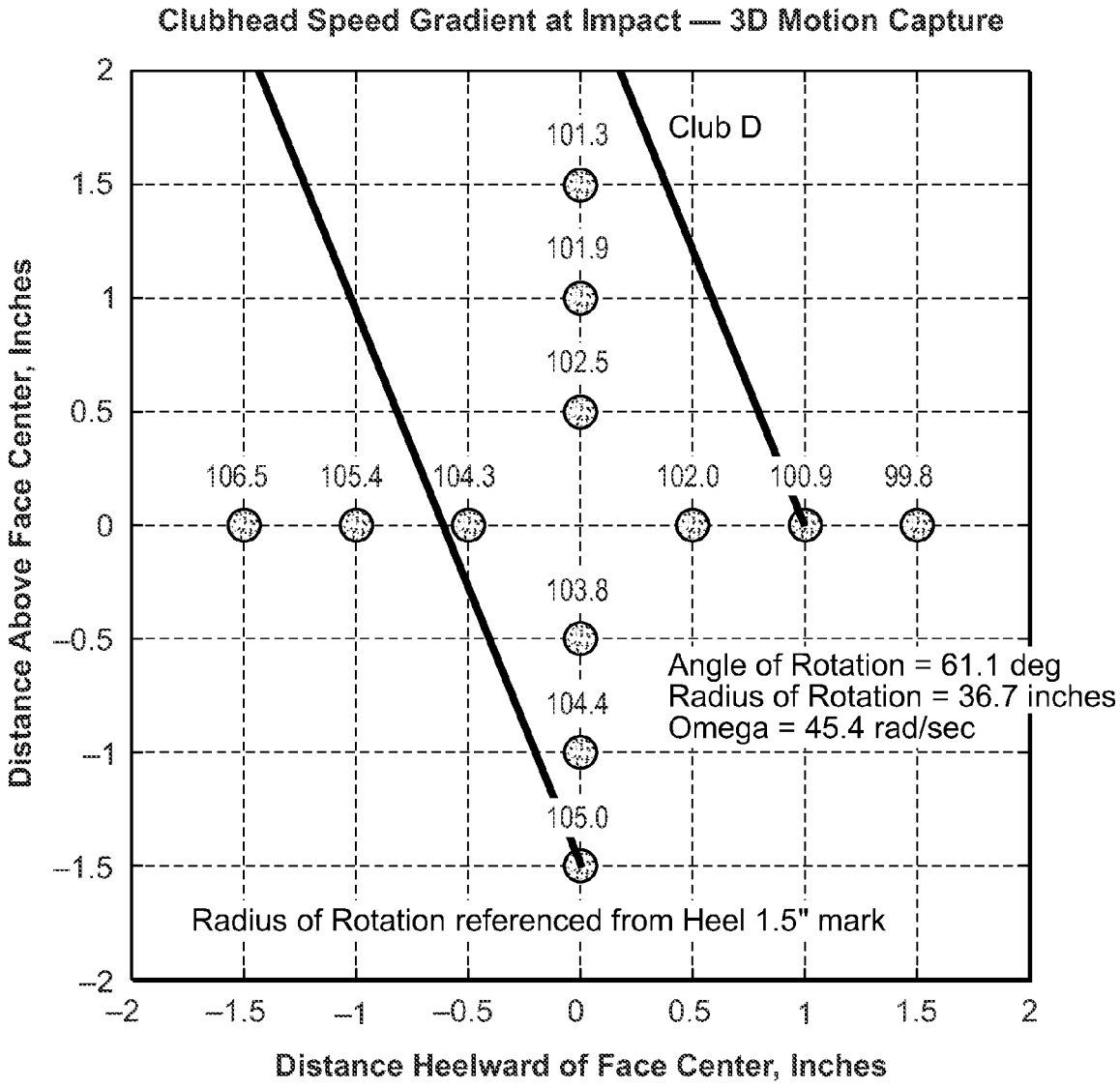
FIG. 3 is a plot of the clubhead speed gradient across a driver club face.

FIG. 3 is a plot of a matrix of club head speeds (in mph) measured at a variety of points on the club face of a driver by a high-speed 3D motion camera. The x-axis depicts the distance, in inches, horizontally from the center of the club face towards both the heel and toe of the face. The y-axis depicts the distance, in inches, horizontally above the center of the club face towards both the crown and the sole of the face. It can be seen that, for these launch conditions, the clubhead speed gradient horizontally across the club face (from heel to toe) is almost 7 mph (99.8 mph at the location closest to the heel and 106.5 mph at the location closest to the toe), and the clubhead speed gradient vertically up the club face (from crown to sole) is almost 4 mph (101.3 mph at the location closest to the crown and 105.0 mph at the location closest to the sole). As such, the "fastest" location on the club face is not at its geometric center but towards the toe. To take advantage of this high-speed location on the club face, the sweet spot must be moved toe-ward.

Figure 4:
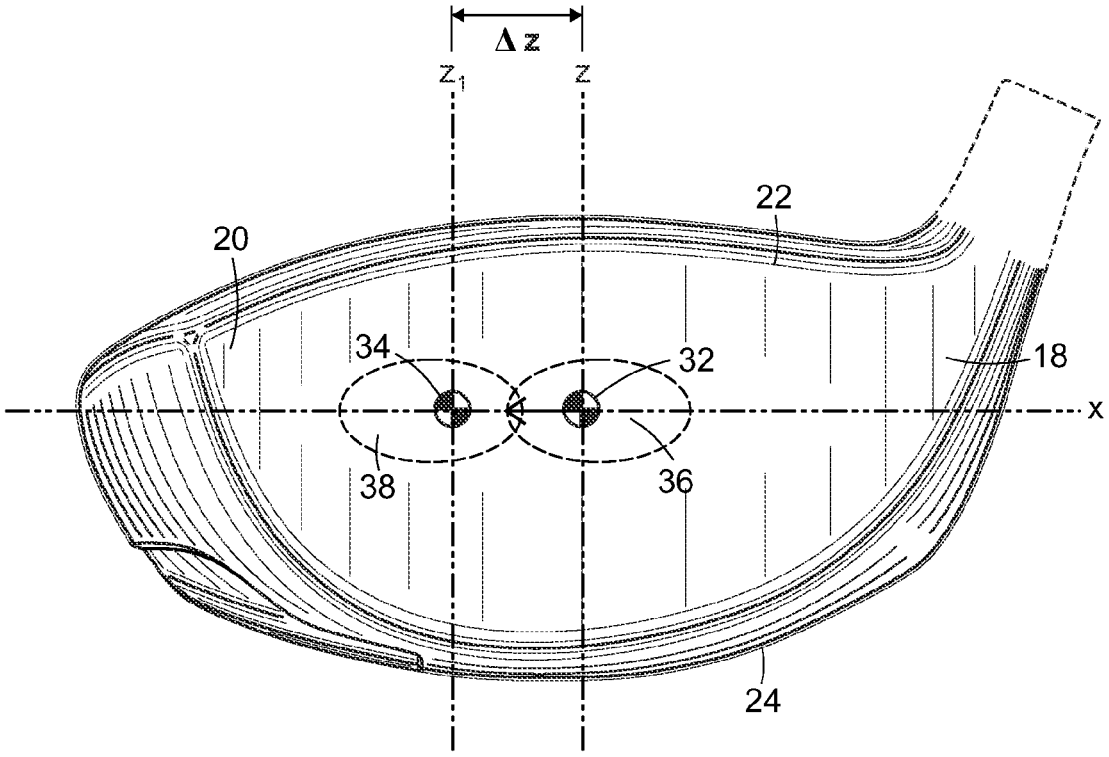
FIG. 4 is face view of one embodiment of the present invention, showing the toe-ward c.g.

Referring to FIG. 4, as mentioned above, the translated center 34 of the club face (and the corresponding vertical plane coplanar with the y- and z-axes) has been moved towards the toe of the club face along axis x. The c.g. of a conventional driver-type club head is centrally located some distance (along the y-axis) behind the sweet spot 36, which is also centrally located. Referring to FIGS. 2 and 4, the c.g. center 32 is located equidistant between the toe 20 and the heel 18, along the x-axis, x. The c.g. center 32 is also typically located equidistant between the sole 24 and the crown 22, along the z-axis, z. In one embodiment of the present invention, the c.g. center 32 is translated along the x-axis towards the toe of the club 20 to become new toe-ward c.g. center 34 (with the actual c.g. being a pre-determined distance behind the c.g. center 34 along the y-axis). Concurrently, the new sweet spot 38 moves in the direction of the toe as well. The translated c.g center 34 and sweet spot 38 are along axis $Z_1$. Preferably, the distance from the geometric center 32 and translated center 34, defined by Δz, is at least 5 mm, preferably at least 10 mm, more preferably at least 15 mm, and most preferably 20 mm to 30 mm. Toe-ward center 34 preferably remains on x-axis, x.

In the embodiments depicted in FIG. 4, the bulge and/or roll of the club head are adjusted along with the translated center. Preferably, the bulge is translated to be directly centered at the location of the translated center. The bulge may have 1 radius of curvature or, more preferably, at least 2 radii of curvature, and most preferably at least 3 radii of curvature. Preferably, the role has a single radius of curvature, U.S. Pat. No. 6,454,664 discloses the use of multiple roll radii or curvature centered about the face of a driver. The use of bulge having multiple radii of curvature is also disclosed. The multiple radii of curvature bulge and roll are suitable for use in the present invention, albeit at different locations on the club face, and the disclosure is incorporated herein by reference thereto.

Figure 5:
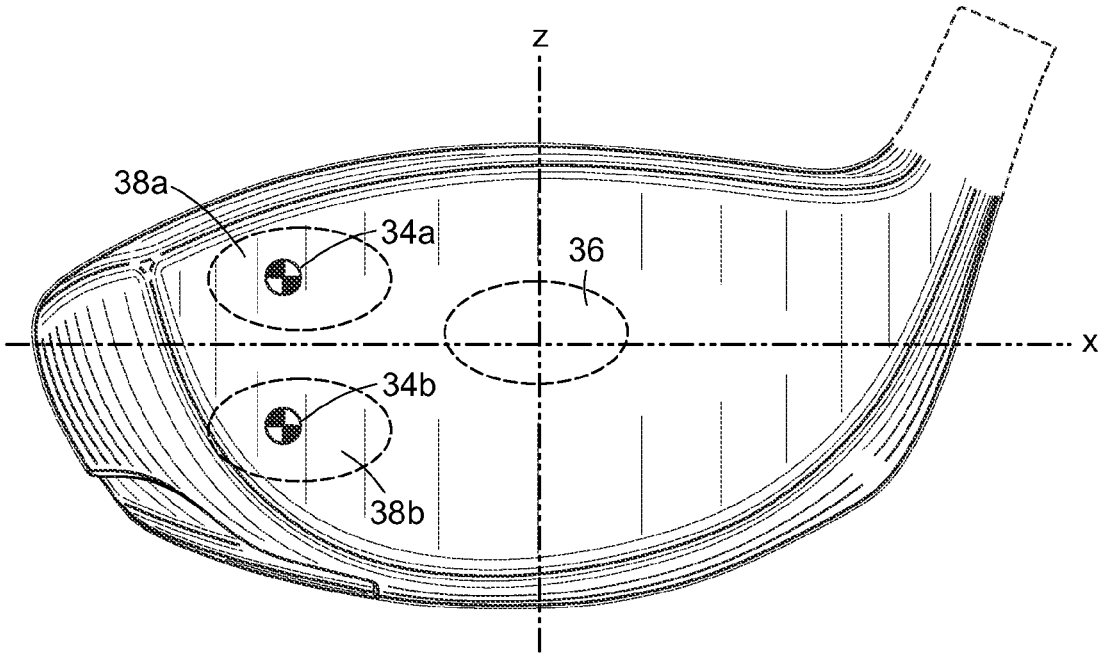
FIG. 5 is a face view of one embodiment of the present invention, showing the toe-ward c.g. that is either above the x-axis or below the x-axis.

Referring to FIG. 5, in an alternative embodiment, the translated center 34*a* and translated sweet spot 38*a* may be higher on the club face, above (towards the crown) x-axis, x, or, alternatively, the translated center 34*b* and translated sweet spot 38*b* may be lower on the club face, below (towards the sole) x-axis, x. Preferably, translated center 34*a* is at least about 1 mm above the x-axis, x, more preferably at least about 2 mm above the x-axis, x, and most preferably at least about 3 mm above the x-axis, x. Alternatively, translated center 34*b* is at least about 1 mm below x-axis, x, more preferably at least about 2 mm below x-axis, x, and most preferably at least about 3 mm below the x-axis, x.

Figure 6:
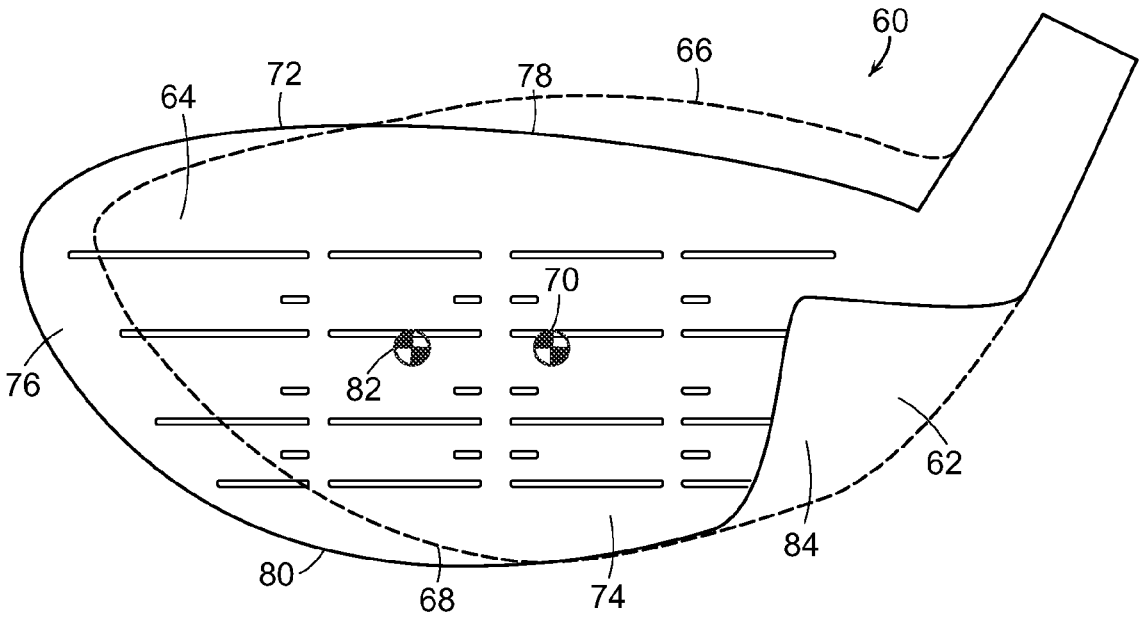
FIG. 6 is a face view of the abbreviated heel embodiment of the present invention.

Referring to FIG. 6, in another embodiment of the present invention, the heel portion of the club face and sole is removed, allowing the weight of the club and, therefore, the c.g., to be moved toe-ward. A conventional driver-type club 60 is depicted in cross-hatch and has a heel portion 62, a toe portion 64, a crown 66, a sole 68, and a geometric center 70. An inventive driver 72 of the invention is depicted in solid line and has an abbreviated heel portion 74, an elongated toe portion 76, a crown 78, a sole 80, and a translated center point 82. A large section of the heel of the conventional club face has been replaced, 84, that allows the weight to be moved towards the toe.

The center of gravity (c.g.) of the club head is preferably translated toe-ward in an equivalent magnitude as the translated center, although in an alternative embodiment, the c.g. of the club head is not congruent with (directly behind) the translated center—it may be either fore (towards the toe) or aft (towards the heel) of said position. The weight from any or all of the crown, sole and skirt/side of the club head can be moved toe-ward to adjust the c.g. of the club head toe-ward. Additionally, a section of the crown closest to the point where the shaft attaches to the club head may be formed from a lightweight material, such as carbon fiber composites, aluminum, magnesium, thermoplastic or thermoset polymers, so that additional weight can be re-deployed towards the toe section.

While any type of golf club head may utilize the relocated sweet spot of the invention, in a preferred embodiment the club head has a hollow internal space, such as a driver or metalwood. The inventive club head should meet all of the size limits set forth by the United States Golf Association (the "USGA"). More particularly, the volume of the club head, when it is a driver, is set at 460 $cm^3$ (cc) or less and its weight is limited to 200 g or less, although non-conforming versions, such as a large volume or high COR driver, are suitable as well. The maximum distance from the club face (also the striking or hitting face) to the aft portion of the club head is preferably 5 inches and the widest part of club head is also preferably 5 inches. Therefore, club head fits within the USGA's 5-inch square requirement. The hitting face is preferably 2 inches high, which is below the USGA's 2.8-inch limit, and is 4 inches long.

Figure 7:
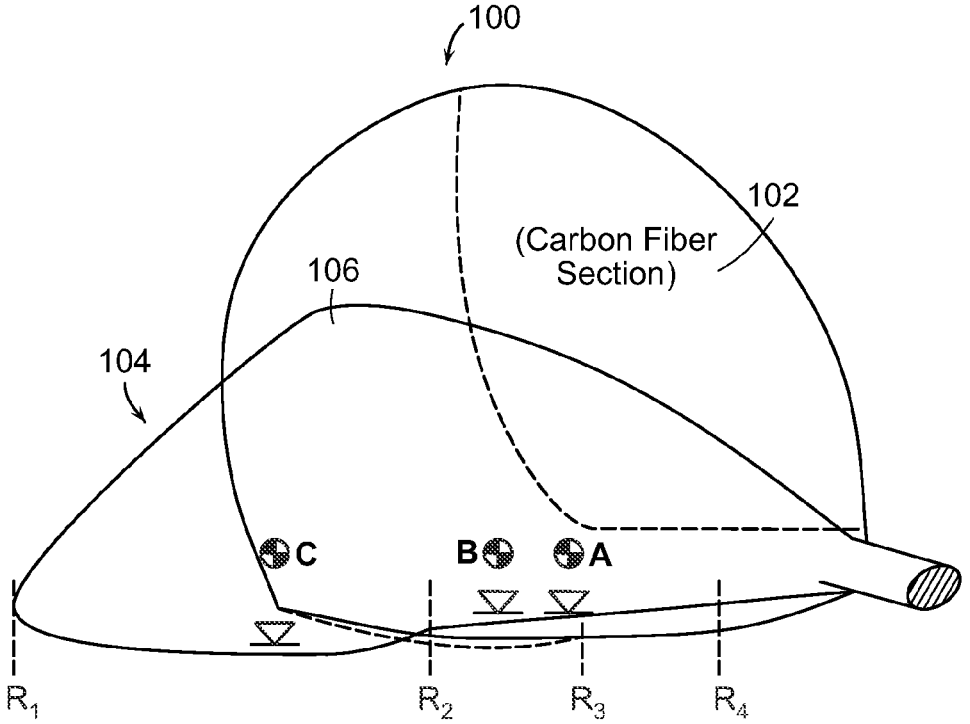
FIG. 7 is a top view of two embodiments of the inventive golf club.
Figure 8:
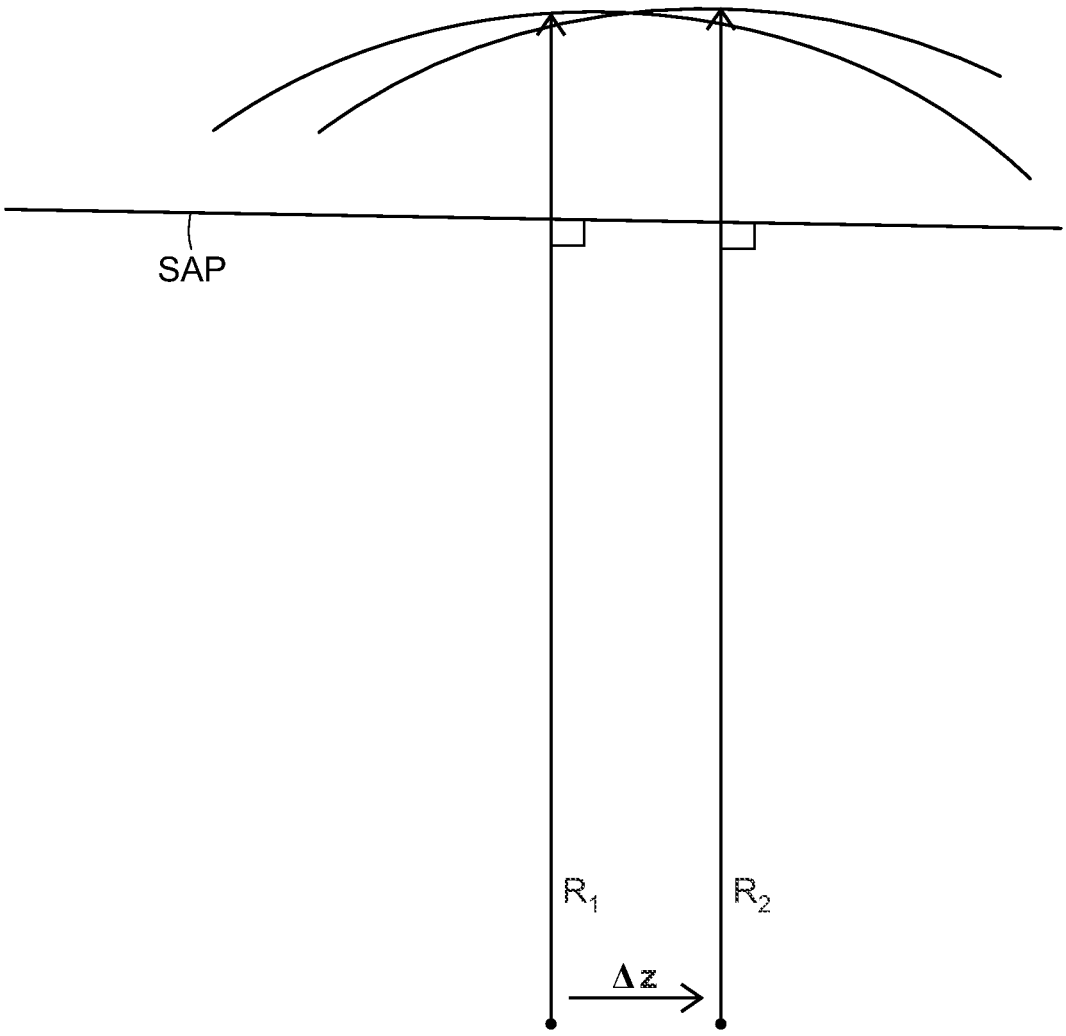
FIG. 8 is a top view of a club face having multiple radii of curvature.

An alternative embodiment of the inventive club head, which may or may not fall within the USGA limits for size, is depicted in FIG. 7. A conventional shaped club head 100 is shown in top view with a centrally located c.g. (and sweet spot) referenced as A. As discussed in more detail below, the crown of the club head 100 may have a section removed and replaced (defined by cross-hatch) with a lightweight material 102, allowing weight to be moved toe-ward to adjust the c.g. and sweet spot toe-ward, per the inventive club head. In the conventional club head 100, the bulge of the hitting face has a single radius of curvature centered at A and axis $R_3$. The inventive club head, however, has the c.g. and sweet spot moved toe-ward to B and has a bulge having at least 2 radii of curvature, one centered at axis $R_2$ and the second centered at axis $R_4$. Referring to FIG. 8, the multiple radii of curvature, $R_1$ and $R_2$, of the inventive club head are depicted, with the center of the two radii of curvature being translated a certain distance, Δz, towards the toe of the club head.

In another, potentially non-conforming embodiment, the club head 104 has a longer hitting face with a shallower-depth crown and body portion 106. The c.g. center is translated out towards the toe of the hitting face and is referenced as C. In this embodiment, the bulge of the hitting face has at least two radii of curvature, one centered between axis $R_1$ and $R_2$, and the second centered at axis $R_4$ (between $R_2$ and the heel).

The materials for firming the body and/or face portion of the club head may be stainless steel, pure titanium, or a titanium alloy. The more preferred material comprises titanium alloys, such as titanium 6-4 alloy, which comprises 6% aluminum and 4% vanadium. The body portion may be manufactured through casting with a face insert, or formed portions with a face insert. Any face inserts located behind the hitting face are made by casting, machining sheet metal or forming sheet metal. Another embodiment can be created by forming a wrapped face, from forging, stamping, powdered metal forming, or metal-injection molding.

Because the club head has an inner cavity, the volume of the inner cavity may be empty, or alternatively, may be filled with foam or another low-specific-gravity material. It is preferred that the inner cavity has a volume greater than 100 cc, and more preferably greater than 300 cc. In other words, the club head design in accordance to the present invention can be used with any driver club, as well as any fairway club, such as a metalwood or a hybrid-type club. Preferably, the mass of the inventive club head is greater than 150 g but less than 250 g, more preferably less than 200 g.

The club heads of the present invention can also be used with other types of hollow golf clubs including, but not limited to, drivers, driving irons, fairway woods, metalwoods, hybrid clubs, specialty sand or wedge-type clubs, or putters.

While various embodiments of the present invention have been described above, it should be understood that they have been presented by way of illustration and example only, and not limitation. will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A golf club head comprising: a striking face having an upper perimeter, a lower perimeter, a heel portion, a toe portion, and a face center located at a geometric center of said striking face; a posterior body portion comprising a crown portion and a sole portion, wherein the crown portion is coupled to the upper perimeter of the striking face and the sole portion is coupled to the lower perimeter of the striking face; a hosel for receiving a shaft; an x-axis extending through said face center, said x-axis substantially parallel to said striking face and extending from said heel portion towards said toe portion; a z-axis extending through said face center, said z-axis perpendicular to said x-axis and extending from said sole towards said crown; and a y-axis extending through said face center; said y-axis perpendicular to said x-axis and said z-axis and extending from striking face towards said posterior body portion; wherein the heel portion is positioned below the hosel and the club head has a c.g. positioned towards the toe portion of the striking face by a distance, Az, from a vertical plane running perpendicularly through the crown, the sole, and the striking face, wherein said vertical plane is co-planar with said z-axis and said y-axis; wherein the club head further comprises a horizontal plane parallel to and positioned between the crown portion and the sole portion as to intersect the heel and the toe, wherein said horizontal plane is co-planar with said x-axis and said y-axis; wherein the striking face comprises bulge and roll, the bulge having at least 2 radii of curvature; and wherein a center of at least 1 of the bulge radii of curvature is positioned an equal distance from the vertical plane as the c.g.

2. The golf club of claim 1, wherein the club head c.g. is positioned at least 5 mm from the vertical plane.

3. The golf club of claim 2, wherein the club head c.g. is positioned at least 10 mm from the vertical plane.

4. The golf club of claim 3, wherein the club head c.g. is positioned at least 15 mm from the vertical plane.

5. The golf club of claim 1, wherein the c.g. is positioned at least 1 mm above the horizontal plane towards the crown portion.

6. The golf club of claim 1, wherein the c.g. is positioned at least 1 mm below the horizontal plane towards the sole portion.

7. The golf club of claim 1, wherein the roll of the striking face is positioned along the horizontal plane.

8. The golf club of claim 1, wherein the crown portion is formed from a first material and a second material lighter than the first.

9. The golf club of claim 8, wherein the second material is positioned closer to the heel than the toe.

10. The golf club of claim of claim 8, wherein the second material comprises carbon fiber composites, aluminum, magnesium, thermoplastic, or thermoset polymers.

11. A golf club head comprising: a striking face having an upper perimeter, a lower perimeter, a heel portion, a toe portion, and a face center located at a geometric center of said striking face; a posterior body portion comprising a crown portion and a sole portion, wherein the crown portion is coupled to the upper perimeter of the striking face and the sole portion is coupled to the lower perimeter of the striking face, the sole portion having an area at least 20% less than the crown portion; a hosel for receiving a shaft; an x-axis extending through said face center, said x-axis substantially parallel to said striking face and extending from said heel portion towards said toe portion; a z-axis extending through said face center, said z-axis perpendicular to said x-axis and extending from said sole towards said crown; and a y-axis extending through said face center; said y-axis perpendicular to said x-axis and said z-axis and extending from striking face towards said posterior body portion; wherein the heel portion is positioned away from the hosel and the club head has a c.g. positioned towards the toe portion of the striking face by a distance, Az, from a vertical plane running perpendicularly through the crown, the sole, and the striking face wherein said vertical plane is co-planar with said z-axis and said y-axis; wherein the striking face comprises bulge and roll, the bulge having at least 2 radii of curvature; and wherein a center of at least 1 of the bulge radii of curvature is positioned an equal distance from the vertical plane as the c.g.

12. The golf club of claim 11, wherein the club head c.g. is positioned at least 5 mm from the vertical plane.

13. The golf club of claim 12, wherein the club head c.g. is positioned at least 10 mm from the vertical plane.

14. The golf club of claim 13, wherein the club head c.g. is positioned at least 15 mm from the vertical plane.

15. The golf club of claim 12, wherein the crown portion is formed from a first material and a second material lighter than the first, wherein the second material is positioned closer to the heel than the toe, and wherein the second material comprises carbon fiber composites, aluminum, magnesium, thermoplastic, or thermoset polymers.

* * * * *